US005165492A

United States Patent [19]

Beasley

[11] Patent Number: 5,165,492

[45] Date of Patent: Nov. 24, 1992

[54] APPARATUS FOR PREVENTING SEPARATION OF A DOWN-HOLE MOTOR FROM A DRILL STRING

[75] Inventor: Thomas R. Beasley, Katy, Tex.

[73] Assignee: Dailey Petroleum Service Corp., Conroe, Tex.

[21] Appl. No.: 604,783

[22] Filed: Oct. 26, 1990

[51] Int. Cl.[5] ..... E21B 4/02; E21B 21/10

[52] U.S. Cl. ..... 175/107; 166/332; 175/234; 175/317; 175/320; 251/149.5; 251/347

[58] Field of Search ..... 166/330, 332; 175/39, 175/40, 107, 317, 320, 322, 232, 234; 251/149.5, 347

[56] References Cited

U.S. PATENT DOCUMENTS

| | | | |
|---|---|---|---|
| 3,191,905 | 6/1965 | Brown | 251/149.5 |
| 3,410,355 | 11/1968 | Garrett | 175/317 |
| 3,989,114 | 11/1976 | Tschirky et al. | 175/107 |
| 4,187,918 | 2/1980 | Clarke | 175/39 |
| 4,331,207 | 5/1982 | Castel | 175/322 |
| 4,632,193 | 12/1986 | Geczy | 175/317 |
| 4,768,598 | 9/1988 | Reinhardt | 175/107 |

*Primary Examiner*—Hoang C. Dang
*Attorney, Agent, or Firm*—Arnold, White & Durkee

[57] ABSTRACT

An apparatus is disclosed for use in a drill string 10 to prevent separation of a lower tubular member 16 from an upper tubular member 15 by a rotational force applied from a down-hole motor 22. The down-hole motor 22 is rotated by drilling fluid pumped from the surface, through a passage formed within the drill string 10, and into the down-hole motor 22. A valve 36 is positioned in the passage in the drill string 10 and has a first operating position adapted for passing the drilling fluid to the down-hole motor 22, and a second operating position adapted for substantially blocking the drilling fluid from being delivered through the down-hole motor 22. The value is of a two piece construction, having a first body 44 connected to an upper tubular section 14 and a second body 46 connected to the down-hole motor 22. Thus, longitudinal movement between the upper tubular section 14 and the down-hole motor 22, which is a result of rotation of the lower tubular section 16 by the motor 22, causes corresponding longitudinal movement of the first and second bodies 44, 46 between the first and second operating positions.

17 Claims, 2 Drawing Sheets

APPARATUS FOR PREVENTING SEPARATION OF A DOWN-HOLE MOTOR FROM A DRILL STRING

BACKGROUND OF THE INVENTION

1. Technical Field

This invention relates generally to an apparatus for preventing the loss of a portion of a down-hole motor if the power section rotates a portion of the motor housing and, in particular, to an apparatus for discontinuing or severely restricting the flow of drilling fluid to a down-hole motor in response to rotation of a portion of the motor housing.

2. Description of the Related Art

In the field of oil well drilling, it is often desirable to use down-hole tools that are rotatable relative to the major portion of the drill string. For example, in some wells, such as horizontally drilled wells, it is desirable that a down-hole motor rotate just the drill bit, rather than having a larger surface motor rotate the entire drill string. Accordingly, it should be readily appreciated that some type of bearing is positioned in the down-hole tool so that the down-hole tool is freely rotatable relative to the drill string.

However, the environment to which such down-hole motors are subjected is extremely hostile. For example, the motor and bearing arrangement is continuously exposed to very high temperatures over very long periods of time with large amounts of debris passing therethrough. Accordingly, it is common for the bearings to occasionally fail. The failed bearings prevent free rotation of the drill bit relative to the motor housing; however, the operators of the drilling operation are ordinarily unaware of such failure and continue to pump drilling fluid through the down-hole motor.

Thus, the continued rotational force applied to the drill bit by the down-hole motor power section has a tendency to rotate the portion of the motor housing below the power section. Rotation of these sections of the down hole motor housing eventually results in at least one of the sections and the drill bit being unscrewed and separated from the remainder of the down-hole motor housing and possibly being lost in the well bore.

Once the motor housing and bit are lost in the well bore, time consuming and expensive "fishing" operations are necessary to attempt to retrieve the lost items. Often these relatively expensive items cannot be retrieved and continue to impede further drilling operations.

It has been suggested that undesirable rotation of the down-hole motor housing can be avoided by threadably attaching the down-hole motor housing to the lower portion of the drill string with left hand threads. Thus, when the down-hole motor applies a rotating force to its own housing, the joint is actually tightened rather than loosened. However, left hand threads have the inherent drawback of being loosened during normal operation. For example, during rotation of the entire drill string, the motor housing engages the subsurface strata and resists likewise rotation, thereby unscrewing the left hand threaded joint with attendant separation.

The present invention is directed to overcoming or minimizing one or more of the problems discussed above.

SUMMARY OF THE INVENTION

In one aspect of the present invention, an apparatus is provided for preventing separation of a first portion of a drill string from a second portion of the drill string by rotational operation of a down-hole motor. The down-hole motor is rotated by drilling fluid pumped from the surface, through a passage formed within the drill string, and into the down-hole motor. A valve is positioned in the passage in the drill string. The valve has a first operating position adapted for passing the drilling fluid to the down-hole motor, and a second operating position adapted for substantially blocking the drilling fluid from being delivered to the down-hole motor. The apparatus includes means for biasing the valve to the second operating position in response to the down-hole motor rotating the first portion of the drill string.

In another aspect of the present invention, an apparatus is provided for preventing separation of a first portion of a drill string from a second portion of the drill string by rotational operation of a down-hole motor. Rotation of the first portion of the drill string causes the first portion of the drill string to be longitudinally spaced from the second portion of the drill string. The down-hole motor is rotated by drilling fluid pumped from the surface, through a passage formed within the drill string, and into the down-hole motor. A valve is positioned in the passage in the drill string. The valve has a first operating position adapted for passing the drilling fluid to the down-hole motor, and a second operating position adapted for substantially blocking the drilling fluid from being delivered to the down-hole motor. The valve includes first and second mating surfaces defining the drilling fluid passage therebetween. The first mating surface is connected to the first portion of the drill string, and the second mating surface is connected to the second portion of the drill string. The first and second mating surfaces are spaced a preselected longitudinal distance apart in the first operating position and contacting one another in the second operating position.

In yet another aspect of the present invention, an apparatus is provided for preventing separation of a first portion of a drill string from a second portion of the drill string by rotational operation of a down-hole motor. Rotation of the first portion of the drill string causes the first portion of the drill string to be longitudinally spaced from the second portion of the drill string. The down-hole motor is rotated by drilling fluid pumped from the surface, through a passage formed within the drill string, and into the down-hole motor. A valve is positioned in the passage in the drill string. The valve has a first operating position adapted for passing the drilling fluid to the down-hole motor, and a second operating position adapted for substantially blocking the drilling fluid from being delivered to the down-hole motor. The valve includes a first body connected to the first portion of the drill string. The first body has a generally cylindrical configuration with first and second longitudinal regions having first and second preselected outer diameters respectively. A first mating surface is formed on the first body at the intersection of the first and second longitudinal regions. A second body is connected to the second portion of the drill string and has a generally tubular configuration generally coaxially positioned about the first body. The second body has third and fourth longitudinal regions having third and fourth preselected inner diameters respectively. A second mating surface is formed on the second body at the intersection of the third and fourth longitudinal regions. The first diameter is less than the second diameter, and the third diameter is less than the fourth and second diameters and greater than the first diameter. The first and second mating surfaces define the drilling fluid passage therebetween and are spaced a preselected longitudinal distance apart in the first operating position and contacting one another in the second operating position.

In still another aspect of the present invention, an apparatus is provided for preventing separation of a first portion of a drill string from a second portion of the drill string by rotation of a down-hole motor. Rotation of the first portion of the drill string causes the first portion of the drill string to be longitudinally spaced from the second portion of the drill string. The down-hole motor is rotated by drilling fluid pumped from the surface, through a passage formed within the drill string, and into the down-hole motor. The apparatus includes a retainer having first and second mating surfaces. The first mating surface is connected to the first portion of the drill string, and the second mating surface is connected to the second portion of the drill string. The first and second mating surfaces are adapted for movement between first and second operating position with corresponding movement and rotation of the first and second portions of the drill string. The first and second mating surfaces are spaced a preselected longitudinal distance apart in the first operating position and contacting one another in the second operating position whereby the first and second portions of the drill string are restricted against further longitudinal movement away from one another.

BRIEF DESCRIPTION OF THE DRAWINGS

Other objects and advantages of the invention will become apparent upon reading the following detailed description and upon reference to the drawings in which.

Figure 1:
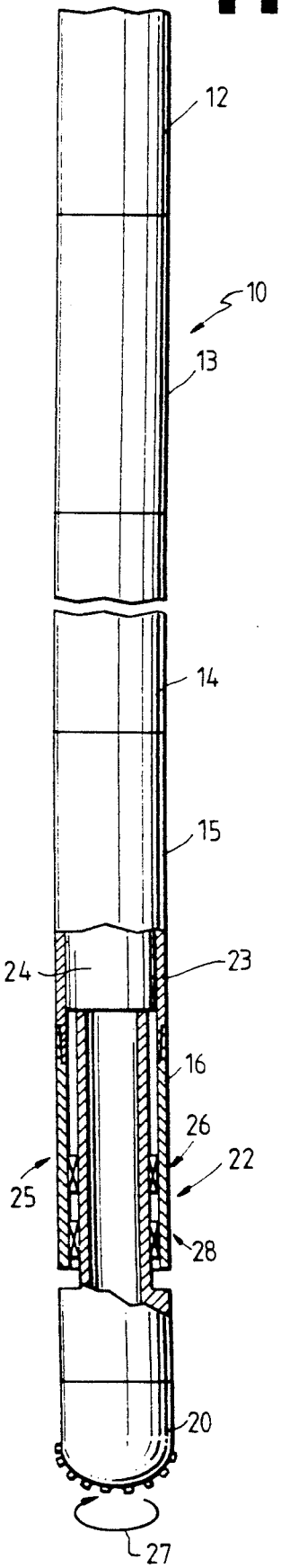
FIG. 1 illustrates a stylized view of a drill string with a partial cross-sectional view of a bearing and down-hole motor arrangement.

While the invention is susceptible to various modifications and alternative forms, specific embodiments thereof have been shown by way of example in the drawings and will herein be described in detail. It should be understood, however, that this specification is not intended to limit the invention to the particular forms disclosed herein, but on the contrary, the intention is to cover all modifications, equivalents, and alternatives falling within the spirit and scope of the invention, as defined by the appended claims.

DESCRIPTION OF A PREFERRED EMBODIMENT

Referring now to the drawings and, in particular, to FIG. 1, a stylized view of a drill string 10 is illustrated. The drill string 10 is composed of a series of tubular members 12, 13, 14, 15, 16 threaded together to form a hollow-core cylinder. Preferably, the tubular members 12, 13, 14, 15, 16 are joined together by threaded connections that employ right hand threads. A drill bit 20 is rotatably connected at the bottom of the drill string 10 via a down-hole motor 22 located in the lowermost tubular members 15, 16. The down-hole motor 22 is schematically shown in a partial cross sectional view and includes a housing 23, a power section 24, and a bearing section 25.

To effect rotation of the drill bit 20 relative to the drill string 10, the conventional down-hole motor 22 is located within the core of the drill string 10 and is operated by pumping drilling fluid therethrough to impart a rotational movement to the drill bit 20. Preferably, the drill bit 20 is rotated in a clockwise direction, as indicated by an arrow 27. Rotational directions discussed herein are conventionally referenced as viewed from a vantage point above the drill string 10.

It should be appreciated that since the drill bit 20 is rotatable relative to the drill string 10, the bearing section 25 is preferably provided to reduce frictional wear therebetween. The bearing section 25 commonly includes at least two sets of bearings 26, 28 spaced longitudinally apart to reduce longitudinal wobbling of the drill bit 20 as it rotates.

In the event that the bearings 26, 28 cease to operate properly so that the drill bit 20 does not freely rotate relative to the drill string 10, then the clockwise rotational force applied to the drill bit 20 is also applied to the drill string 10 through the bearings 26, 28 and, in particular, to the lower tubular member 16 of the housing 23. Since the lower tubular member 16 is attached to the upper tubular member 15 via right hand threads, the clockwise rotation of the lower tubular member 16 tends to unscrew the lower tubular member 16 from the upper tubular member 15 until they separate.

Figure 2:
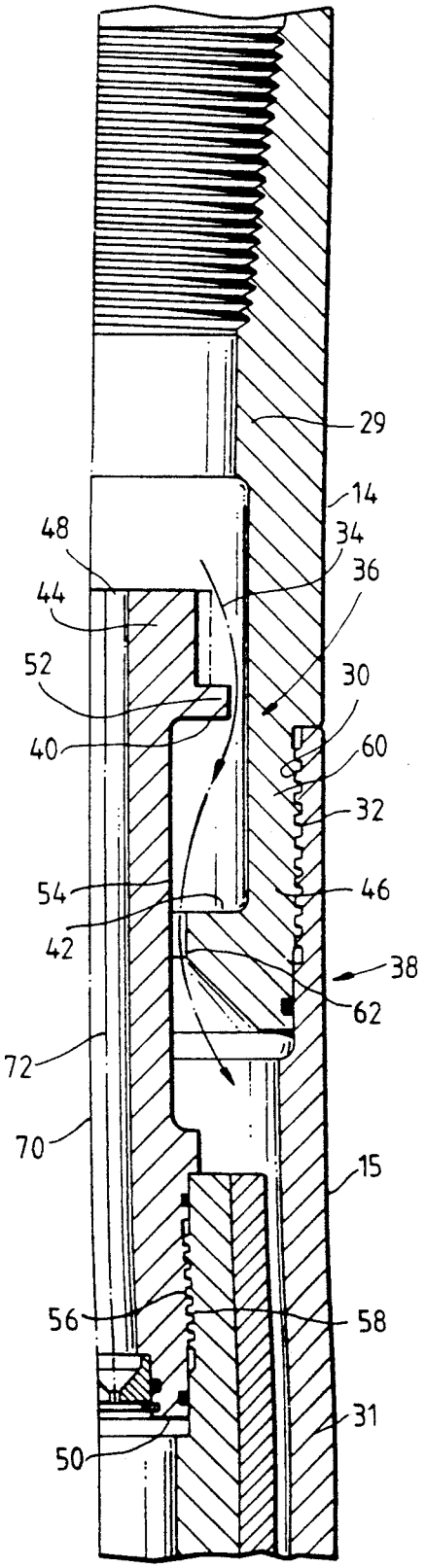
FIG. 2 illustrates a longitudinal half-sectional view of a section of a drill string that includes the joint formed between the down-hole motor and the drill string.

Referring now to FIG. 2, a longitudinal half-sectional view of a section of the drill string 10 that includes the joint formed between tubular members 14, 15 is shown. In FIG. 2, dotted lines down the left side are identified as center lines. The upper tubular member 14 has an outer sidewall 29 that includes a longitudinal section 30 having an outer diameter slightly less than the outer diameter of the remaining portion of the sidewall 29. This longitudinal section 30 has formed on its outer surface a conventional threaded portion that is of the type typically referred to as right hand threads.

Conversely, the lower tubular member 15 has an outer sidewall 31 that includes a longitudinal section 32 having an inner diameter slightly less than the remaining portion of the sidewall 31. The inner diameter of the longitudinal section 32 substantially corresponds to the outer diameter of the longitudinal section 30. Moreover, the longitudinal section 32 has formed on its inner periphery a conventional threaded portion that is also of the type typically referred to as right hand threads.

The threaded portions of the longitudinal sections 30, 32 are substantially similar so as to allow the tubular members 14, 15 to be joined together by counterclockwise rotation of the lower tubular member 15. During normal operation, the tubular members 14, 15, 16 remain joined together to form a substantially unitary construction with a drilling fluid passage formed in the core thereof.

It should be appreciated that the drilling fluid applied to the motor 22 serves the tripartite purpose of driving the down-hole motor 22, carrying away the debris generated by the cutting action of the drill bit 20, and cooling and lubricating the bearings 26, 28. Accordingly, after the drilling fluid passes through the down-hole motor 22, a small volume passes through the bearings and exits the drill string 10, and the remaining volume is delivered through the drill bit 20. Thus, for proper operation of the drill string 10, a drilling fluid passage is formed in the core of the drill string both above and below the down-hole motor 22.

A portion of the drilling fluid passage is illustrated by arrow an 34 extending past the joint formed at the junction of tubular members 14, 15. The passageway 34 extends through a valve 36, which is operable to a first operating position adapted for passing the drilling fluid to the down-hole motor 22, and a second operating position adapted for substantially blocking the drilling fluid from being delivered to the down-hole motor 22. In the diagram of FIG. 2, the valve 36 is shown biased to the first operating position. That is, the valve 36 is open and drilling fluid freely flows through the down-hole motor 22 and to the drill bit 20.

Means 38 biases the valve 36 from its first to its second operating position in response to rotation of the lower tubular member 16 relative to the upper tubular member 15. In other words, rotation of the lower tubular member 16 unscrews the lower tubular member 16 from the tubular member 15, causing a longitudinal displacement of the lower tubular member 16 and the rotor of the down-hole motor 22. Thus, by connecting the valve between the tubular member 14, and the rotor of the down-hole motor 22, this longitudinal movement of the lower tubular member 16 is used to actuate the valve 36 and discontinue operation of the down-hole motor 22.

The valve 36 has first and second mating surfaces 40, 42, which define the drilling fluid passage. It can be seen that the drilling fluid passage, as defined by the arrow 34, passes between the first and second mating surfaces 40, 42. Thus, as long as the mating surfaces 40, 42 remain in the first operating position illustrated in FIG. 2, drilling fluid continues to flow and operate the down-hole motor 22. However, if the mating surfaces 40, 42 are urged together, the drilling fluid passage is substantially sealed against continued flow of the drilling fluid and the down-hole motor 22 ceases to operate. Further, since the fluid passage 34 is now blocked, but the operators are likely unaware of this blockage, drilling fluid is still being pumped to the down-hole motor 22. Accordingly, the pressure of the drilling fluid begins to rise significantly, functioning as an indication to the operators that the bearings 26, 28 have seized and the down-hole motor 22 is no longer driving the drill bit 20.

Preferably, the distance between the mating surfaces 40, 42 is less than the length of the threaded portions 30, 32 of tubular members 14, 16. Thus, the valve 36 closes before any of the tubular members 14, 15, 16 separate. However, even if the length of the threaded portions 30, 32 of the tubular members 14, 15, 16 is less than the distance between the mating surfaces 40, 42, the mating surfaces 40, 42 still engage to prevent complete separation of the tubular members 14, 15, 16. In other words, the tubular member 15 hangs from the tubular member 14 via the mating surfaces 40, 42 to prevent complete separation. However, the valve 36 still operates properly to prevent further rotation of the down-hole motor 22, thereby causing a rise in pressure of the drilling fluid, which signals the operators that a malfunction has occurred.

The valve 36 consists essentially of a first and second body 44, 46. The first body 44 is ultimately connected to the down-hole motor 22 so that it moves rotationally and longitudinally therewith. The first body 44 is generally cylindrical in configuration with a closed first end portion 48 and an open second end portion 50. The closed first end portion 48 is positioned upstream in the drilling fluid passage so that the drilling fluid has an open passage only about the annulus formed between the first body 44 and the outer walls 29, 31 of the tubular members 14, 15. This passage, of course, extends between the first and second mating surfaces 40, 42. In some embodiments, it is desireable that a relatively small amount of fluid be allowed to bypass the valve 36 through a passage extending through the center (not shown) of the valve 36. This bypass passage allows the drill bit 20 to be rotated at a slower speed but still provide adequate drilling fluid flow to the drill bit 20 to remove the cutting debris.

The first mating surface 40 is formed at the junction of first and second longitudinal portions 52, 54 of the first body 44. The first and second longitudinal portions 52, 54 have substantially different outer diameters so that the first mating surface 40 takes the form of a lower surface of a shoulder that has width equal to the difference in the radii of the first and second longitudinal portions 52, 54. The first longitudinal portion 52 has a diameter that is substantially larger than the second longitudinal portion 54.

The open end 50 of the first body has a threaded portion formed on its outer circumferential surface 56, which engages with a similarly threaded portion on an interior circumferential surface 58 of the down-hole motor 22. Preferably, the threaded portions on the surfaces 56, 58 are of the type conventionally referred to as left hand threads. It should be appreciated that clockwise rotation of the down-hole motor housing 23 has a tendency to unscrew conventional right hand threads, such as those between the tubular members 15, 16. Thus, to prevent the first body 44 from being unscrewed from and separating from the down-hole motor 22 left hand threads are employed.

The use of left hand threads to join the first body 44 to the down-hole motor 22 does not have the same inherent drawback as using left hand threads to join the tubular members 15, 16 together. While left hand threads in the joint between tubular members 15, 16 resist being unscrewed by rotation of the lower tubular member 16, it is inherently subject to being unscrewed by rotation of the entire drill string 10. Conversely, the left hand threads joining the first body 44 and the down-hole motor 22 are not subject to being unscrewed by rotation of the entire drill string 10 or by rotation of the down-hole motor housing 23.

The advantage of the left hand threads between the first body 44 and the down-hole motor 22 is conveniently described by way of example. Assuming that the bearings 26, 28 have seized and no longer allow rotation between the drill bit 20 and the lower tubular member 16, then continued rotation of the down-hole motor 22 imparts a clockwise rotational force (see arrow 27 in FIG. 1) to the lower tubular member 16. The lower tubular member 16 is unscrewed from the upper tubular member 15 by this rotational force until the mating surfaces 40, 42 of the valve 36 engage one another, impeding the flow of drilling fluid through the down-hole motor 22 and preventing further rotation. However, as the mating surfaces 40, 42 contact one another, a force is exerted on the first body 44, which would tend to unscrew the first body 44 from the down-hole motor 22 if they were connected together by right hand threads. The left hand threaded connection, however, is simply further tightened by the force.

The second body 46 of the valve 36 has a generally tubular configuration generally coaxially positioned about the first body 44. Like the first body 44, the second body 46 has first and second longitudinal regions 60, 62, which have substantially different inner diameters. Preferably, the first longitudinal region 60 has an inner diameter that is greater than the outer diameter of the first longitudinal region 52 of the first body 54 but less than the inner diameter of the second longitudinal region 62 of the second body 46. Further, the outer diameter of the second longitudinal region 54 of the of the first body 44 is preferably less than the inner diameter of the second longitudinal region 62 of the second body 46.

This configuration allows the first and second bodies 44, 46 to move longitudinally within each other to space the mating surfaces 40, 42 apart or together so as to open or close the valve 36. It should be appreciated that closing the valve 36 functions as a highly detectable signal to the operators of the drilling process that the drill bit 20 has ceased to rotate properly. When the valve closes, the flow of drilling fluid from the surface is interrupted. This interruption of flow is readily identifiable by the operators as a significant and continuous rise in the pressure of the drilling fluid.

The second body 46 is illustrated as being integrally formed with the outer wall 29 of the upper tubular member 14, but could readily take the form of a separate body attached to the outer wall 29 by, for example, welding or by threaded connection. Preferably, a threaded connection between the outer wall 29 and the second body 46 would take the form of left hand threads for the same reason discussed above in conjunction with the connection between the first body 44 and the down-hole motor 22.

Figure 3:
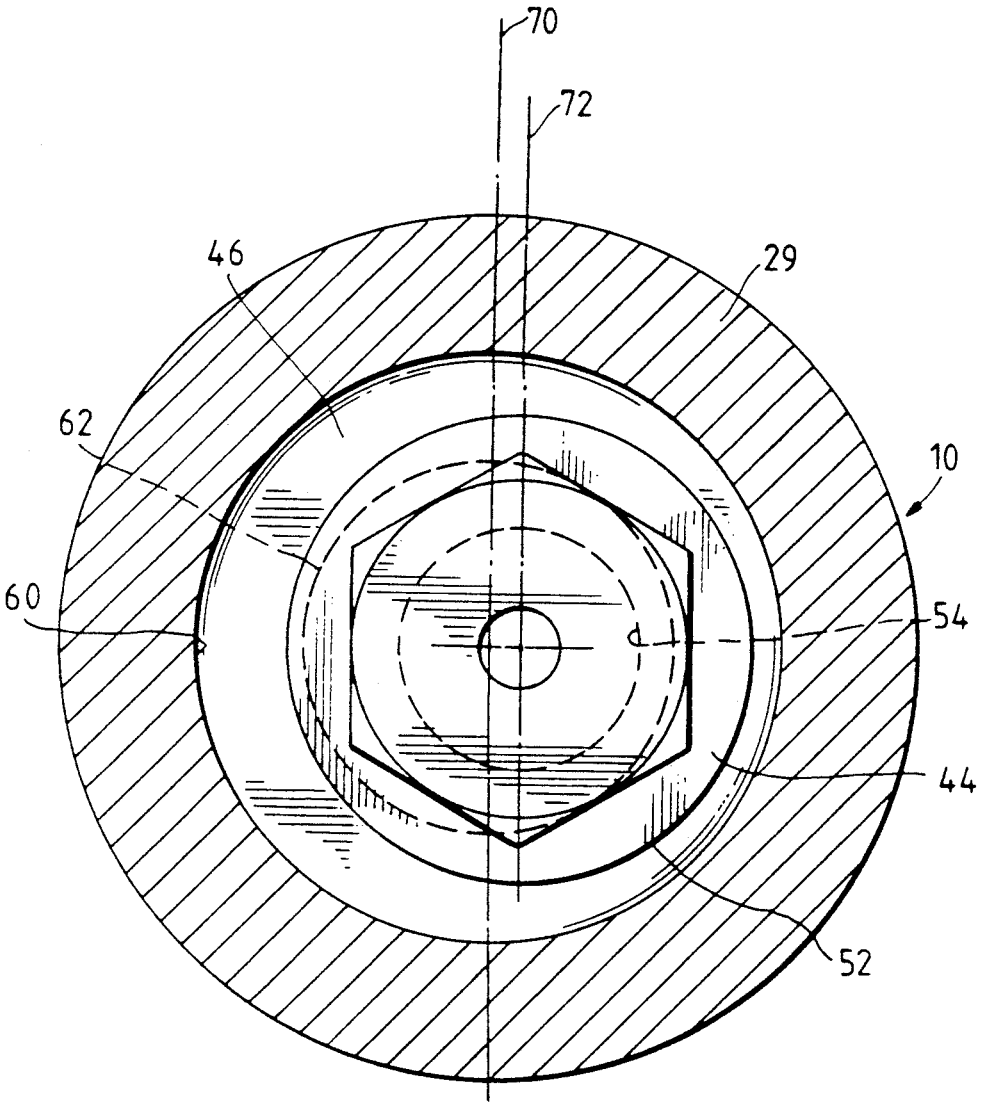
FIG. 3 illustrates a cross sectional end view of the drill string adjacent the joint illustrated in FIG. 2.

Referring now to FIG. 3, a cross sectional end view of the drill string 10 adjacent the joint illustrated in FIG. 2 is shown. In particular, the cross section through the drill string 10 is taken at a point slightly above the first body 44 so as to further illustrate the relationship of the valve 36 with the drill string 10.

Two offset coordinate systems 70, 72 are superimposed over the cross section. The first coordinate system 70 represents the radial centerpoint of the drill string 10 and, in particular, the second body 46 of the valve 36. The second coordinate system 72 represents the centerpoint of the rotor of the down-hole motor 22 and is offset slightly from the centerpoint of the drill string 10. As is conventional, proper operation of the down-hole motor 22 requires that it be offset from the longitudinal axis of the drill string 10.

This offset in the down-hole motor 22 requires that the diameters of the first and second bodies 44, 46 be carefully selected to ensure sufficient overlap of the mating surfaces 40, 42. The outer diameter of the first longitudinal section 52 of the first body 44 should be greater than the inner diameter of the second longitudinal section 62 of the second body 46 by a distance at least as large as the offset.

Conversely, to ensure that the first and second bodies 44, 46 are free to move longitudinally within one another, the diameter of the first longitudinal section 52 of the first body 44 should be less than the diameter of the first longitudinal section 60 of the second body 46 by a distance at least as large as the offset. This same relationship should be observed between the second longitudinal sections 54, 62 of the first and second bodies 44, 46.

It should be appreciated that the first and second bodies 44, 46 have been described herein as being generally or substantially coaxially arranged. However, as is apparent from FIG. 3, the longitudinal axes of the first and second bodies 44, 46 are, in fact, offset by a distance corresponding to the offset of the down-hole motor 22 from the drill string 10 longitudinal axis. Thus, the term coaxial has been used in a general sense only to describe that approximate relationship between the first and second bodies 44, 46. The axes of the first and second bodies 44, 46 can depart from precisely coaxial by a substantial distance without departing from the meaning of our use of the phrases "generally or substantially coaxial."

I claim:

1. An apparatus for preventing separation of a first portion of a drill string from a second portion of the drill string by rotation of a down-hole motor, said down-hole motor being rotated by drilling fluid pumped from the surface, through a passage formed within said drill string, and into said down-hole motor, said apparatus comprising:

a valve positioned in the passage in said drill string, said valve having a first operating position adapted for passing said drilling fluid to said down-hole motor, and a second operating position adapted for substantially blocking said drilling fluid from being delivered to said down-hole motor and for preventing separation of said first portion from said second portion; and means for biasing said valve to said second operating position in response to said down-hole motor rotating the first portion of said drill string.

2. An apparatus, as set forth in claim 1, wherein rotation of the first portion of said drill string causes the first portion of said drill string to be spaced from the second portion of said drill string, said biasing means includes said valve being operatively connected between the first and second portions of said drill string whereby the valve is biased to said second operating position in response to the first portion of said drill string being spaced from the second portion of said drill string.

3. An apparatus, as set forth in claim 1, wherein rotation of the first portion of said drill string causes the first portion of said drill string to be longitudinally spaced from the second portion of said drill string, and said valve includes first and second mating surfaces defining the drilling fluid passage therebetween, and said biasing means includes said first mating surface being connected to the first portion of said drill string, and said second mating surface being connected to the second portion of said drill string, said first and second mating surfaces being spaced a preselected longitudinal distance apart in said first operating position and contacting one another in said second operating position.

4. An apparatus, as set forth in claim 3, wherein said valve includes a first body having a generally cylindrical configuration with first and second longitudinal regions having first and second preselected outer diameters respectively, said first mating surface being formed on said first body at the intersection of said first and second longitudinal regions, and a second body having a generally tubular configuration coaxially positioned about said first body, said second body having third and fourth longitudinal regions having third and fourth preselected inner diameters respectively, said second mating surface being formed on said second body at the intersection of said third and fourth longitudinal regions, said first diameter being less than said second diameter, said third diameter being less than said fourth and second diameters and greater than said first diameter, and said biasing means includes said first body being connected to said first portion of said drill string and said second body being connected to said second portion of said drill string.

5. An apparatus, as set forth in claim 4, wherein said first portion of said drill string is connected to said second portion of said drill string via right hand threads, said down-hole motor rotates in a clockwise direction, said second body is integrally formed into said second portion of said drill string, and said first body is connected to the first portion of said drill string via left hand threads.

6. An apparatus, as set forth in claim 4, wherein said first portion of said drill string is connected to said second portion of said drill string via right hand threads, said down-hole motor rotates in a clockwise direction, said first body is integrally formed into said first portion of said drill string, and said second body is connected to the second portion of said drill string via left hand threads.

7. An apparatus for preventing separation of a first portion of a drill string from a second portion of the drill string by rotation of a down-hole motor, rotation of the first portion of said drill string causing the first portion of said drill string to be longitudinally spaced from the second portion of said drill string, said down-hole motor being rotated by drilling fluid pumped from the surface, through a passage formed within said drill string, and into said down-hole motor, said apparatus comprising:

a valve positioned in the passage in said drill string, said valve having a first operating position adapted for passing said drilling fluid to said down-hole motor, and a second operating position adapted for substantially blocking said drilling fluid from being delivered to said down-hole motor and for preventing separation of said first portion from said second portion;

said valve including first and second mating surfaces defining the drilling fluid passage therebetween, said first mating surface being connected to the first portion of said drill string, and said second mating surface being connected to the second portion of said drill string, said first and second mating surfaces being spaced a preselected longitudinal distance apart in said first operating position and contacting one another in said second operating position.

8. An apparatus, as set forth in claim 7, wherein said valve includes a first body connected to the first portion of said drill string and having a generally cylindrical configuration with first and second longitudinal regions having first and second preselected outer diameters respectively, said first mating surface being formed on said first body at the intersection of said first and second longitudinal regions, and a second body connected to the second portion of said drill string and having a generally tubular configuration coaxially positioned about said first body, said second body having third and fourth longitudinal regions having third and fourth preselected inner diameters respectively, said second mating surface being formed on said second body at the intersection of said third and fourth longitudinal regions, said first diameter being less than said second diameter, said third diameter being less than said fourth and second diameters and greater than said first diameter.

9. An apparatus, as set forth in claim 8, wherein said first portion of said drill string is connected to said second portion of said drill string via right hand threads, said down-hole motor rotates in a clockwise direction, said second body is integrally formed into said second portion of said drill string, and said first body is connected to the first portion of said drill string via left hand threads.

10. An apparatus, as set forth in claim 8, wherein said first portion of said drill string is connected to said second portion of said drill string via right hand threads, said down-hole motor rotates in a clockwise direction, said first body is integrally formed into said first portion of said drill string, and said second body is connected to the second portion of said drill string via left hand threads.

11. An apparatus for preventing separation of a first portion of a drill string from a second portion of the drill string by rotation of a down-hole motor, rotation of the first portion of said drill string causing the first portion of said drill string to be longitudinally spaced from the second portion of said drill string, said down-hole motor being rotated by drilling fluid pumped from the surface, through a passage formed within said drill string, and into said down-hole motor, said apparatus comprising:

a valve positioned in the passage in said drill string, said valve having a first operating position adapted for passing said drilling fluid to said down-hole motor, and a second operating position adapted for substantially blocking said drilling fluid from being delivered to said down-hole motor and for preventing separation of said first portion from said second portion;

said valve including:

a first body connected to the first portion of said drill string and having a generally cylindrical configuration with first and second longitudinal regions having first and second preselected outer diameters respectively a first mating surface being formed on said first body at the intersection of said first and second longitudinal regions; and a second body connected to the second portion of said drill string and having a generally tubular configuration coaxially positioned about said first body, said second body having third and fourth longitudinal regions having third and fourth preselected inner diameters respectively, a second mating surface being formed on said second body at the intersection of said third and fourth longitudinal regions, said first diameter being less than said second diameter, said third diameter being less than said fourth and second diameters and greater than said first diameter;

said first and second mating surfaces defining the drilling fluid passage therebetween and being spaced a preselected longitudinal distance apart in said first operating position and contacting one another in said second operating position.

12. An apparatus, as set forth in claim 11, wherein said first portion of said drill string is connected to said second portion of said drill string via right hand threads, said down-hole motor rotates in a clockwise direction, said second body is integrally formed into said second portion of said drill string, and said first body is connected to the first portion of said drill string via left hand threads.

13. An apparatus, as set forth in claim 11, wherein said first portion of said drill string is connected to said second portion of said drill string via right hand threads, said down-hole motor rotates in a clockwise direction, said first body is integrally formed into said first portion of said drill string, and said second body is connected to the second portion of said drill string via left hand threads.

14. An apparatus for preventing separation of a first portion of a drill string from a second portion of the drill string by rotation of a down-hole motor, rotation of the first portion of said drill string causing the first portion of said drill string to be longitudinally spaced from the second portion of said drill string, said down-hole motor being rotated by drilling fluid pumped from the surface, through a passage formed within said drill string, and into said down-hole motor, said apparatus comprising:

a retainer having first and second mating surfaces, said first mating surface being connected to the first portion of said drill string, and said second mating surface being connected to the second portion of said drill string, said first and second mating surfaces being adapted for movement between first and second operating positions with corresponding movement and rotation of said first and second portions of said drill string, said first and second mating surfaces being spaced a preselected longitudinal distance apart in said first operating position and contacting one another in said second operating position whereby said first and second portions of said drill string are restricted against further longitudinal movement away from one another.

15. An apparatus, as set forth in claim 14, wherein said retainer includes a first body connected to the first portion of said drill string and having a generally cylindrical configuration with first and second longitudinal regions having first and second preselected outer diameters respectively, said first mating surface being formed on said first body at the intersection of said first and second longitudinal regions, and a second body connected to the second portion of said drill string and having a generally tubular configuration coaxially positioned about said first body, said second body having third and fourth longitudinal regions having third and fourth preselected inner diameters respectively, said second mating surface being formed on said second body at the intersection of said third and fourth longitudinal regions, said first diameter being less than said second diameter, said third diameter being less than said fourth and second diameters and greater than said first diameter.

16. An apparatus, as set forth in claim 15, wherein said first portion of said drill string is connected to said second portion of said drill string via right hand threads, said down-hole motor rotates in a clockwise direction, said second body is integrally formed into said second portion of said drill string, and said first body is connected to the first portion of said drill string via left hand threads.

17. An apparatus, as set forth in claim 15, wherein said first portion of said drill string is connected to said second portion of said drill string via right hand threads, said down-hole motor rotates in a clockwise direction, said first body is integrally formed into said first portion of said drill string, and said second body is connected to the second portion of said drill string via left hand threads.

* * * * *